US010401133B1

(12) United States Patent
Sullivan

(10) Patent No.: US 10,401,133 B1
(45) Date of Patent: Sep. 3, 2019

(54) BOWFISHING ARROW NOCK ADAPTER

(71) Applicant: Kevin M. Sullivan, Lakemont, GA (US)

(72) Inventor: Kevin M. Sullivan, Lakemont, GA (US)

( * ) Notice: Subject to any disclaimer, the term of this patent is extended or adjusted under 35 U.S.C. 154(b) by 0 days.

(21) Appl. No.: 15/837,674

(22) Filed: Dec. 11, 2017

Related U.S. Application Data

(60) Provisional application No. 62/432,305, filed on Dec. 9, 2016.

(51) Int. Cl.
*F42B 6/06* (2006.01)

(52) U.S. Cl.
CPC ..... *F42B 6/06* (2013.01)

(58) Field of Classification Search
CPC ... F42B 6/04; F42B 6/06; A01K 81/00; A01K 81/04
USPC ..... 473/578
See application file for complete search history.

(56) References Cited

U.S. PATENT DOCUMENTS 2,747,876 A * 5/1956 Teller ..... F42B 6/04 156/191
4,905,397 A * 3/1990 Juelg, Jr. ..... F42B 6/04 43/6
5,067,731 A * 11/1991 Bickel ..... F42B 6/06 473/578
5,094,464 A * 3/1992 Musacchia, Sr. ..... A01K 81/04 403/349
5,306,020 A * 4/1994 Bolt ..... F42B 6/06 473/578
5,417,439 A * 5/1995 Bickel ..... F42B 6/06 473/578
5,547,200 A * 8/1996 Rangel ..... F42B 6/04 403/282
5,553,413 A * 9/1996 Gannon ..... A01K 81/00 43/6
5,611,542 A * 3/1997 Saunders ..... F42B 6/08 473/578
5,803,843 A * 9/1998 Anderson ..... F42B 6/06 403/277
5,919,105 A * 7/1999 Summers ..... F42B 6/06 473/578
6,517,453 B2 * 2/2003 LaSee ..... F42B 6/04 124/86
7,331,886 B2 * 2/2008 Morris ..... F42B 6/06 473/578
7,909,714 B2 * 3/2011 Cyr ..... F42B 6/06 473/578
8,257,208 B2 * 9/2012 Harding ..... F42B 6/06 473/578

(Continued)

*Primary Examiner* — Alexander R Niconovich
(74) *Attorney, Agent, or Firm* — Akerman LLP; Michael K. Dixon

(57) ABSTRACT

A bowfishing nock adapter providing a robust stop supporting element configured to support a bowfishing line stop and to support a nock is disclosed. The bowfishing nock adapter may be formed from an elongated adapter body configured to be attached to a distal end of an arrow at a proximal end of the elongated adapter body. The elongated adapter body may include an arrow retention system that, once crimped, prevents the bowfishing nock adapter from being removed from an arrow. The bowfishing nock adapter includes a stop supporting element configured to support a bowfishing line stop such that the bowfishing line stop is removable.

20 Claims, 4 Drawing Sheets

(56) References Cited

U.S. PATENT DOCUMENTS

| | | | | |
|---|---|---|---|---|
| 8,267,815 | B2 * | 9/2012 | Braun | A63B 65/02 473/578 |
| 8,777,786 | B1 * | 7/2014 | Bay | F42B 6/06 473/578 |
| 9,028,347 | B2 * | 5/2015 | Pedersen | F42B 6/06 473/578 |
| 9,212,874 | B1 * | 12/2015 | Harding | F42B 6/06 |
| 9,714,818 | B2 * | 7/2017 | Mook | F42B 6/06 |
| 10,234,251 | B2 * | 3/2019 | Ans | F42B 6/06 |
| 2011/0218062 | A1 * | 9/2011 | Braun | A63B 65/02 473/578 |
| 2013/0170900 | A1 * | 7/2013 | Bay | F16B 7/025 403/343 |
| 2013/0267359 | A1 * | 10/2013 | Pedersen | F42B 6/06 473/570 |
| 2017/0086433 | A1 * | 3/2017 | Braun | A01K 81/04 |
| 2017/0292820 | A1 * | 10/2017 | Brown | A01K 81/00 |

* cited by examiner

BOWFISHING ARROW NOCK ADAPTER

CROSS REFERENCE TO RELATED APPLICATION

This application claims the benefit of U.S. Provisional Patent Application No. 62/432,305, filed on Dec. 9, 2016.

FIELD OF THE INVENTION

This invention is directed generally to fish harvesting systems, and more particularly to equipment usable for bowfishing arrows.

BACKGROUND

Bowfishing equipment has been used throughout the years to successfully harvest fish of all varieties. Typically, an arrow used for bowfishing includes an arrowhead with a barb for keeping the fish attached to the arrow once shot and includes a retrieval line attached to a safety slide that slides between the arrowhead and a stop that is typically near the nock at the other end of the arrow. This configuration enables the retrieval line to be positioned between the arrow head and the bow when the bow is drawn, thereby preventing the retrieval line from catching on the bow or arrow rest. The safety slide slides to the nock end of the arrow once shot to provide better flight characteristics for the arrow. Movement of the safety slide is prevented by the stop. The stop is attached to the arrow via a screw that is screwed into a hole drilled in the arrow shaft. The hole drilled into the arrow shaft weakens the arrow shaft.

SUMMARY OF THE INVENTION

A bowfishing nock adapter providing a robust stop supporting element configured to support a bowfishing line stop and to support a nock is disclosed. The bowfishing nock adapter may be formed from an elongated adapter body configured to be attached to a distal end of an arrow at a proximal end of the elongated adapter body. The elongated adapter body may include an arrow retention system that, once crimped, prevents the bowfishing nock adapter from being removed from an arrow. The bowfishing nock adapter may include a stop supporting element configured to support a bowfishing line stop such that the bowfishing line stop is removable.

In at least one embodiment, the bowfishing nock adapter may be formed from an elongated adapter body configured to be attached to a distal end of an arrow at a proximal end of the elongated adapter body. The elongated adapter body may be configured to support a nock at a distal end of the elongated adapter body. The stop supporting element may be configured to support a bowfishing line stop, whereby the stop supporting element may be positioned between the proximal and distal ends of the elongated adapter body.

The elongated adapter body may include an arrow receiving cavity with an opening at the proximal end of the elongated adapter body, whereby the arrow receiving cavity may be configured to receive a proximal end of an arrow. The arrow receiving cavity may include an arrow retention system configured to enable the elongated adapter body to be securely attached to the arrow. The arrow retention system may be formed such that once assembled, an inner surface of the arrow receiving cavity at least partially contacts an outer surface of a connection portion of the arrow and an outer surface of the elongated adapter body radially outward of the arrow receiving cavity is aligned with an outer surface of the arrow. The inner surface of the elongated adapter body forming the arrow receiving cavity may be nonparallel with the outer surface of the elongated adapter body. The opening of the arrow receiving cavity of the elongated adapter body forming the arrow receiving cavity, once assembled, may have a width that is less than a width of the arrow receiving cavity at a point between the opening of the arrow receiving cavity and an end of the arrow receiving cavity positioned within the elongated adapter body, thereby preventing the elongated adapter body from being pulled off of the arrow. The arrow retention system may be formed from an outer cross-sectional thickness of the elongated adapter body at the opening of the arrow receiving cavity that may be greater than an outer cross-sectional thickness of the elongated adapter body at a point between the opening of the arrow receiving cavity and an end of the arrow receiving cavity positioned within the elongated adapter body.

The elongated adapter body being configured to support a nock at a distal end of the elongated adapter body may include a nock receiving cavity having an opening at the distal end of the elongated adapter body. The nock receiving cavity may extend between 10 percent and 40 percent of an overall length of the elongated adapter body. The nock receiving cavity may be configured to receive a male connection of a nock. The nock receiving cavity may include one or more slots positioned in a wall of the elongated adapter body. The slot positioned in a wall of the elongated adapter body may extend generally aligned with a longitudinal axis of the elongated adapter body.

The bowfishing nock adapter may also include a body reduction section positioned between the proximal and distal ends of the elongated adapter body. The body reduction section may be formed from an outer surface with at least a portion positioned radially closer to a longitudinal axis of the elongated adapter body than an outer surface radially outward of an arrow receiving cavity and an outer surface radially outward of a nock receiving cavity. The stop supporting element may be configured to support a bowfishing line stop and may be formed from one or more holes extending into the elongated adapter body. In at least one embodiment, the stop supporting element may include a line stop integrally formed with the stop supporting element such that the line stop and the stop supporting element are a unitary member. The hole extending into the elongated adapter body may include a releasable connection system. In at least one embodiment, the releasable connection system of the hole may be one or more threads.

An advantage of the bowfishing nock adapter is that a bowfishing line stop may be attached to an arrow via the bowfishing nock adapter without compromising the strength of the arrow as occurred in convention bowfishing arrows.

Another advantage of the bowfishing nock adapter is that the bowfishing nock adapter may be formed from robust materials enabling the bowfishing line stop to be securely attached to the bowfishing nock adapter so that minimal risk exists that the bowfishing line stop be stripped from the bowfishing nock adapter.

Yet another advantage of the bowfishing nock adapter is that once the bowfishing nock adapter is attached to an arrow, the bowfishing nock adapter cannot be inadvertently removed.

Another advantage of the bowfishing nock adapter is that once the bowfishing nock adapter is attached to an arrow, an outer surface of the bowfishing nock adapter is flush with an outer surface forming the arrow.

Still another advantage of the bowfishing nock adapter is that the bowfishing nock adapter is configured to receive a nock at a distal end, thereby allowing choices in nock style, color and size.

Another advantage of the bowfishing nock adapter is that the nock that is attached to adapter may be easily replaced should the nock break or for any other reason.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
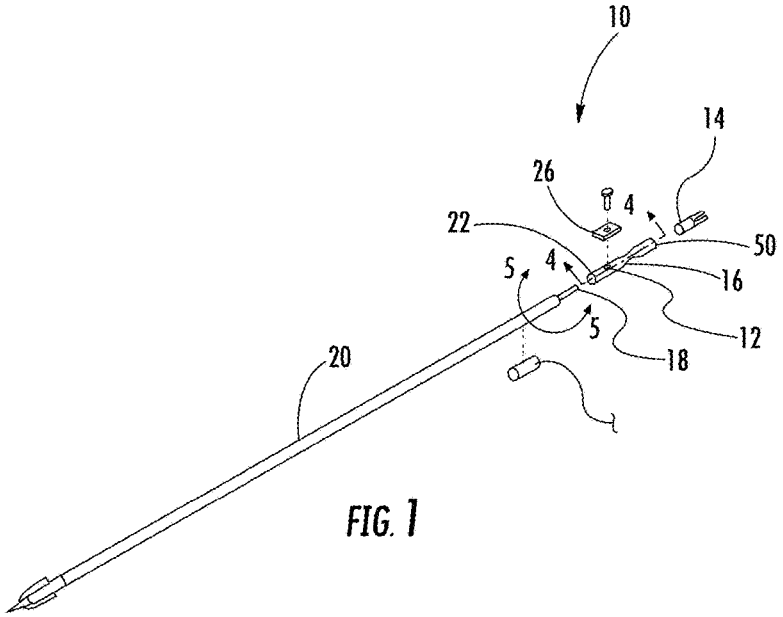
FIG. 1 is an exploded perspective view of a bowfishing nock adapter attached to an arrow.

As shown in FIGS. 1-6, a bowfishing nock adapter 10 providing a robust stop supporting element 12 configured to support a bowfishing line stop 26 and to support a nock 14 is disclosed. The bowfishing nock adapter 10 may be formed from an elongated adapter body 16 configured to be attached to a distal end 18 of an arrow 20 at a proximal end 22 of the elongated adapter body 16. The elongated adapter body 16 may include an arrow retention system 24 that, once crimped, prevents the bowfishing nock adapter 10 from being removed from an arrow 20. The bowfishing nock adapter 10 includes a stop supporting element 12 configured to support a bowfishing line stop 26 such that the bowfishing line stop 26 is removable.

Figure 2:
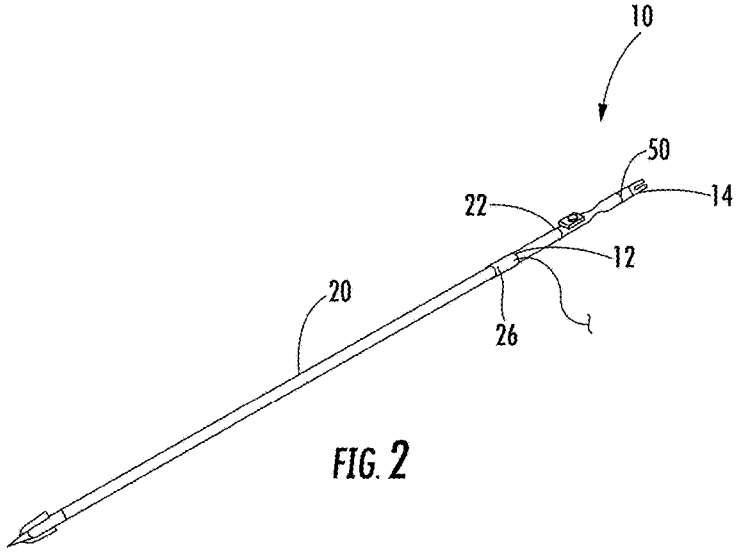
FIG. 2 is an assembled perspective view of the bowfishing nock adapter of FIG. 1 attached to an arrow.

In at least one embodiment, as shown in FIGS. 1 and 2, the bowfishing nock adapter 10 may be formed from an elongated adapter body 16 configured to be attached to a distal end 18 of an arrow 20, such as, but not limited to, a bowfishing arrow, at a proximal end 22 of the elongated adapter body 16. The elongated adapter body 16 may be configured to support a nock 14 at a distal end 50 of the elongated adapter body 16. The bowfishing nock adapter 10 may also include a stop supporting element 12 configured to support a bowfishing line stop 26, wherein the stop supporting element 12 is positioned between the proximal and distal ends 22, 50 of the elongated adapter body 16. The stop element 12 may be, but is not limited to being, a screw, a small member configured to match the outer shape of an arrow 20 and the like. In at least one embodiment, the elongated adapter body 16 may be formed from materials, such as, but not limited to, carbon, plastic, and metal, such as, but not limited to, aluminum, stainless steel, steel and titanium. In at least one embodiment, the elongated adapter body 16 may be cylindrical. In other embodiments, the elongated adapter body 16 may have another shape. Once installed via crimping, the elongated adapter body 16 may have an outer diameter dimension generally equal to an outer diameter dimension of an arrow 20 to which the elongated adapter body 16 is designed to be attached.

Figure 3:
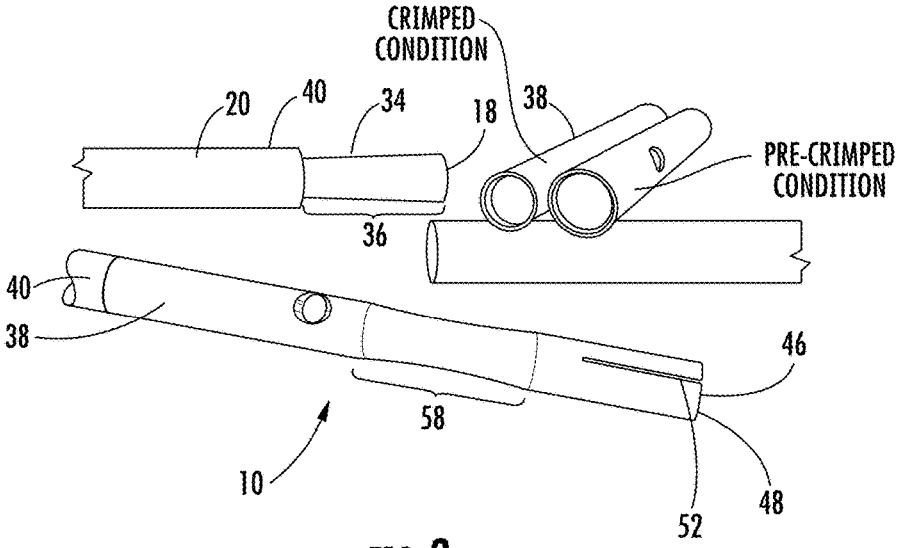
FIG. 3 displays a distal end of an arrow, a bowfishing nock adapter attached to distal end of another arrow and two other bowfishing nock adapters resting on another arrow.
Figure 4:
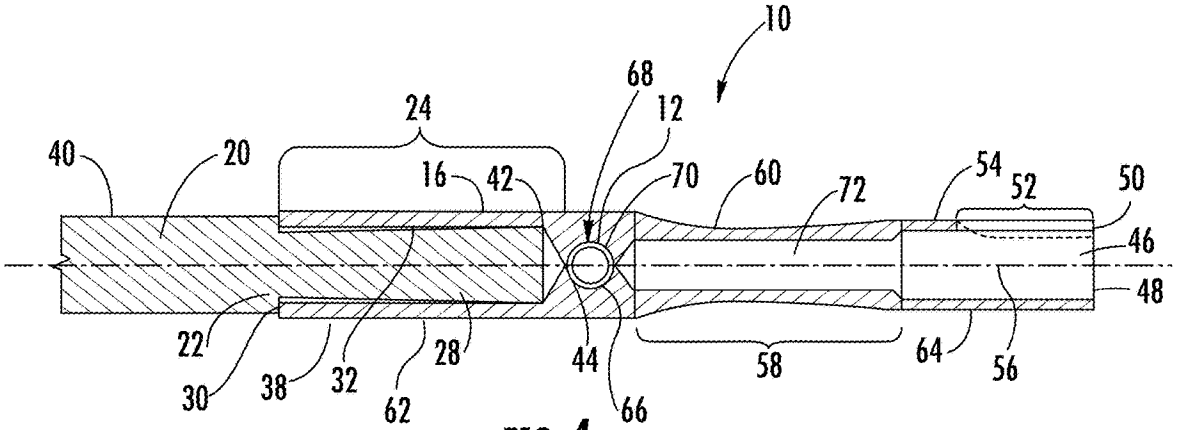
FIG. 4 is a cross-sectional view of the bowfishing nock adapter taken at section line 4-4 in FIG. 1.
Figure 5:
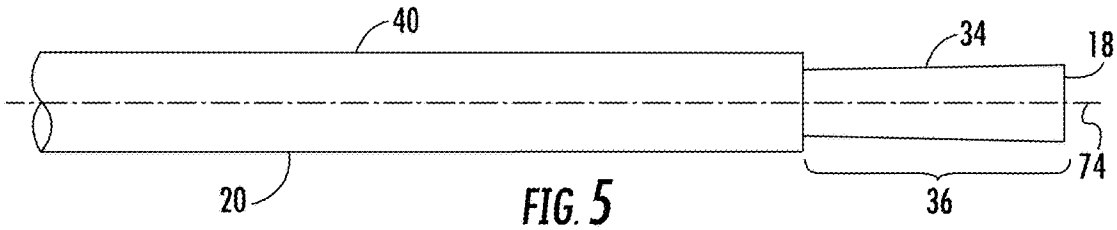
FIG. 5 is a detailed view of the distal end of the arrow taken at detail line 5-5 in FIG. 1.

As shown in FIG. 4, the elongated adapter body 16 may include an arrow receiving cavity 28 with an opening 30 at the proximal end 22 of the elongated adapter body 16. The arrow receiving cavity 28 may be configured to receive a distal end 18 of an arrow 20, as shown in FIG. 5. The arrow receiving cavity 28 may be configured such that the distal end 18 of an arrow 20 contacts a bottom of the arrow receiving cavity 28 at point 42. The arrow receiving cavity 28 may include an arrow retention system 24 configured to enable the elongated adapter body 16 to be securely attached to the arrow 20. The arrow retention system 24 may be formed such that once assembled, an inner surface 32 of the arrow receiving cavity 28 at least partially contacts an outer surface 34 of a connection portion 36 of the arrow 20, and an outer surface 38 of the elongated adapter body 16 radially outward of the arrow receiving cavity 28 may be aligned with an outer surface 40 of the arrow 20, as shown in FIG. 3. The arrow retention system 24 may be used to attach the bowfishing nock adapter 10 to an arrow 20 by crimping the material defining the arrow retention system 24 and the arrow receiving cavity 28. Before the arrow retention system 24 is crimped to the arrow 20, the outer surface 38 of the bowfishing nock adapter 10 at opening 30 of the arrow receiving cavity 28 has a larger outer diameter than a diameter of the outer surface 40 of the arrow 20. Once crimped to the arrow 20, the outer surface 38 of the bowfishing nock adapter 10 may be flush with the outer surface 40 of the arrow 20. The bowfishing nock adapter 10 is shown in both the pre-crimped state and crimped state in FIG. 3.

The inner surface 32 of the elongated adapter body 16 forming the arrow receiving cavity 28 may be nonparallel with the outer surface 38 of the elongated adapter body 16. In particular, a thickness of the elongated adapter body 16 forming the arrow receiving cavity 28 may be tapered, being thicker at the opening 30 than at the end 44. As shown in FIG. 4, the opening 30 of the arrow receiving cavity 28 of the elongated adapter body 16 forming the arrow receiving cavity 28, once assembled, has a width that is less than a width of the arrow receiving cavity 28 at a point 42 between the opening 30 of the arrow receiving cavity 28 and an end 44 of the arrow receiving cavity 28 positioned within the elongated adapter body 16, thereby preventing the elongated adapter body 16 from being pulled off of the arrow 20. The arrow retention system 24 may be formed from an outer cross-sectional thickness of the elongated adapter body 16 at the opening 30 of the arrow receiving cavity 28 that is greater than an outer cross-sectional thickness of the elongated adapter body 16 at a point 42 between the opening 30 of the arrow receiving cavity 28 and an end 44 of the arrow receiving cavity 28 positioned within the elongated adapter body 16. Similarly, the connection portion 36 of the arrow 20 may have a matching configuration. In particular, the distal end 18 of the connection portion 36 may have a width that is greater than a width at the intersection of the connection portion 36 and the remainder of the arrow 20. As such, the outer surface 34 is nonparallel and nonorthogonal with a longitudinal axis 74 of the arrow 20.

The elongated adapter body 16 may be configured to support a nock 14, as shown in FIGS. 1 and 2, at a distal end 50 of the elongated adapter body 16. As shown in FIG. 4, the distal end 50 of the elongated adapter body 16 may include a nock receiving cavity 46 having an opening 48 at the distal end 50 of the elongated adapter body 16. The nock receiving cavity 46 may extend into the elongated adapter body a sufficient distance to enable a nock 14 to be attached to the elongated adapter body 16. In at least one embodiment, the nock receiving cavity 46 may extend into the elongated adapter body 16 between 10 percent and 40 percent of an overall length of the elongated adapter body 16. The nock receiving cavity 46 may be configured to receive a male connection of a nock 14. The nock receiving cavity 28 may include one or more slots 52 positioned in a wall 54 of the elongated adapter body 16. The slot 52 positioned in a wall 54 of the elongated adapter body 16 may extend generally aligned with a longitudinal axis 56 of the elongated adapter body 16.

The bowfishing nock adapter 10 may include a body reduction section 58 positioned between the proximal and distal ends 22, 50 of the elongated adapter body 16. The body reduction section 58 may be formed from an outer surface 60 with at least a portion positioned radially closer to a longitudinal axis 56 of the elongated adapter body 16 than an outer surface 62 radially outward of an arrow receiving cavity 28 and an outer surface 64 radially outward of a nock receiving cavity 46. The body reduction section 58 has a narrower outer diameter than portions of the elongated adapter body 16 positioned distally and proximally of the body reduction section 58. The outer surface 60 forming the body reduction section 58 may be curved. In at least one embodiment, the outer surface 60 forming the body reduction section 58 may be concave.

The stop supporting element 12 may be configured to support a bowfishing line stop 26, as shown in FIGS. 1 and 2, and may be formed from one or more holes 66 extending into the elongated adapter body 16. As shown in FIG. 4, the hole 66 extending into the elongated adapter body 16 may include a releasable connection system 68. The releasable connection system 68 may be formed from one or more threads in the hole 66. The bowfishing line stop 26 may include a releasable connection system 68 enabling the bowfishing line stop 26 to be attached to the stop supporting element 12. In at least one embodiment, the releasable connection system 68 of the bowfishing line stop 26 may be one or more threads 70 extending from the bowfishing line stop 26 to mate with the stop supporting element 12. As such, the bowfishing line stop 26 may be threaded into the stop supporting element 12.

The bowfishing nock adapter 10 may include a nock battery receiving cavity 72, as shown in FIG. 4, for holding a battery extending from a nock having the capability of being an illuminated nock once an arrow has been shot. In at least one embodiment, the nock battery receiving cavity 72 may have a width that is less than a width of the nock receiving cavity 46. In at least one embodiment, the nock battery receiving cavity 72 may have a diameter that is less than a diameter of the nock receiving cavity 46. The nock battery receiving cavity 72 may extend inwardly of the body reduction section 58.

The bowfishing nock adapter 10 may be attached to an arrow 20 by sliding the connection portion 36 of the arrow 20 into the opening 30 of the arrow receiving cavity 28 so that the connection portion 36 seats within the arrow receiving cavity 28. The wall 54 forming the elongated adapter body 16 and the arrow receiving cavity 28 may be crimped so that the inner surface 32 of the arrow receiving cavity 28 at least partially contacts an outer surface 34 of a connection portion 36 of the arrow 20. The outer surface 38 of the elongated adapter body 16 radially outward of the arrow receiving cavity 28 may also then be aligned with an outer surface 40 of the arrow 20. Once the elongated adapter body 16 is crimped to the arrow 20 via the connection portion 36, the bowfishing nock adapter 10 cannot be removed from the arrow 20.

Figure 6:
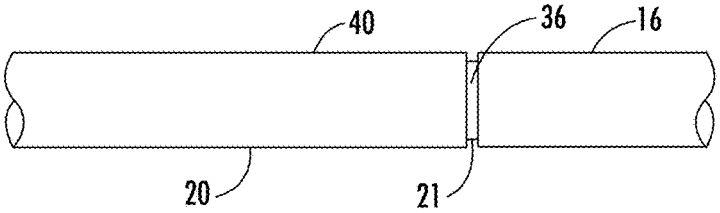
FIG. 6 is a partial side view of the bowfishing nock adapter attached to an arrow in which the distal end of an arrow contacts a bottom of the arrow receiving cavity thereby creating a gap between an outer surface of the bowfishing nock adapter and an outer surface of the arrow.

In another embodiment, the bowfishing nock adapter 10 may be attached to an arrow 20 via an adhesive. The adhesive may form a thin layer between the inner surface 32 of the arrow receiving cavity 28 and the outer surface 34 of the connection portion 36 of the arrow 20. In at least one embodiment, as shown in FIG. 6, the arrow receiving cavity 28 may be configured such that the distal end 18 of an arrow 20 contacts a bottom of the arrow receiving cavity 28. In such a configuration, a gap 21 will exist between the elongated adaptor body 16 and the main body of the arrow 20. When the adhesive is used to create a thin layer between the inner surface 32 of the arrow receiving cavity 28 and the outer surface 34 of the connection portion 36 of the arrow 20 the adhesive builds up in the gap 21 between the elongated adaptor body 16 and the main body of the arrow 20. The adhesive may remain within the gap 21, such as by curing or hardening, to form a smooth transition between an outer surface 40 of the arrow 20 and the outer surface 38 of the elongated adapter body 16.

The bowfishing line stop 26 may be attached to the bowfishing nock adapter 10 by attaching the bowfishing line stop 26 to the stop supporting element 12. In at least one embodiment, a threaded shaft may extend from the bowfishing line stop 26 and be threaded into the stop supporting element 12 to attach the bowfishing line stop 26 to the bowfishing nock adapter 10. In at least one embodiment, the stop supporting element 12 may include a line stop 26 integrally formed with the stop supporting element 12 such that the line stop 26 and the stop supporting element 12 are a unitary member.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A bowfishing nock adapter comprising:

an elongated adapter body configured to be attached to a distal end of an arrow at a proximal end of the elongated adapter body;

wherein the elongated adapter body is configured to support a nock at a distal end of the elongated adapter body;

wherein the elongated adapter body includes an arrow receiving cavity with an opening at the proximal end of the elongated adapter body, wherein the arrow receiving cavity is configured to receive a proximal end of an arrow; and wherein the arrow receiving cavity includes an arrow retention system configured to enable the elongated adapter body to be securely attached to the arrow with mechanical restraint and without adhesive, wherein the arrow retention system is formed such that once assembled, an inner surface of the arrow receiving cavity at least partially contacts an outer surface of a connection portion of the arrow and an outer surface of the elongated adapter body radially outward of the arrow receiving cavity is aligned with an outer surface of the arrow;

wherein the inner surface of the elongated adapter body forming the arrow receiving cavity is nonparallel with the outer surface of the elongated adapter body;

wherein the opening of the arrow receiving cavity of the elongated adapter body forming the arrow receiving cavity, once assembled, has a width that is less than a width of the arrow receiving cavity at a point between the opening of the arrow receiving cavity and an end of the arrow receiving cavity positioned within the elongated adapter body, thereby preventing the elongated adapter body from being pulled off of the arrow.

2. The bowfishing nock adapter of claim 1, wherein the elongated adapter body being configured to support a nock at a distal end of the elongated adapter body comprises a nock receiving cavity having an opening at the distal end of the elongated adapter body.

3. The bowfishing nock adapter of claim 2, wherein the nock receiving cavity includes at least one slot positioned in a wall of the elongated adapter body.

4. The bowfishing nock adapter of claim 3, wherein the at least one slot positioned in a wall of the elongated adapter body extends generally aligned with a longitudinal axis of the elongated adapter body.

5. The bowfishing nock adapter of claim 1, further comprising a body reduction section positioned between the proximal and distal ends of the elongated adapter body, wherein the body reduction section is formed from an outer surface with at least a portion positioned radially closer to a longitudinal axis of the elongated adapter body than an outer surface radially outward of an arrow receiving cavity and an outer surface radially outward of a nock receiving cavity.

6. The bowfishing nock adapter of claim 1, further comprising a stop supporting element configured to support a bowfishing line stop, wherein the stop supporting element is positioned between the proximal and distal ends of the elongated adapter body.

7. The bowfishing nock adapter of claim 6, wherein the stop supporting element is configured to support a bowfishing line stop, is formed from at least one hole extending into the elongated adapter body and includes a releasable connection system.

8. The bowfishing nock adapter of claim 7, wherein the releasable connection system of the at least one hole is a least one thread.

9. The bowfishing nock adapter of claim 7, wherein the stop supporting element includes a line stop integrally formed with the stop supporting element such that the line stop and the stop supporting element are a unitary member.

10. A bowfishing nock adapter comprising:

an elongated adapter body configured to be attached to a distal end of an arrow at a proximal end of the elongated adapter body;

wherein the elongated adapter body is configured to support a nock at a distal end of the elongated adapter body;

wherein the elongated adapter body includes an arrow receiving cavity with an opening at the proximal end of the elongated adapter body, wherein the arrow receiving cavity is configured to receive a proximal end of an arrow; and wherein the arrow receiving cavity includes an arrow retention system configured to enable the elongated adapter body to be securely attached to the arrow with mechanical restraint and without adhesive, wherein the arrow retention system is formed such that once assembled, an inner surface of the arrow receiving cavity at least partially contacts an outer surface of a connection portion of the arrow and an outer surface of the elongated adapter body radially outward of the arrow receiving cavity is aligned with an outer surface of the arrow;

wherein the arrow retention system is formed from an outer cross-sectional thickness of the elongated adapter body at the opening of the arrow receiving cavity is greater than an outer cross-sectional thickness of the elongated adapter body at a point between the opening of the arrow receiving cavity and an end of the arrow receiving cavity positioned within the elongated adapter body.

11. The bowfishing nock adapter of claim 10, further comprising a body reduction section positioned between the proximal and distal ends of the elongated adapter body, wherein the body reduction section is formed from an outer surface with at least a portion positioned radially closer to a longitudinal axis of the elongated adapter body than an outer surface radially outward of an arrow receiving cavity and an outer surface radially outward of a nock receiving cavity.

12. The bowfishing nock adapter of claim 10, further comprising a stop supporting element configured to support a bowfishing line stop, wherein the stop supporting element is positioned between the proximal and distal ends of the elongated adapter body, wherein the stop supporting element is configured to support a bowfishing line stop, is formed from at least one hole extending into the elongated adapter body and includes a releasable connection system.

13. A bowfishing nock adapter, comprising:

an elongated adapter body configured to be attached to a distal end of an arrow at a proximal end of the elongated adapter body;

wherein the elongated adapter body is configured to support a nock at a distal end of the elongated adapter body;

a stop supporting element configured to support a bowfishing line stop, wherein the stop supporting element is positioned between the proximal and distal ends of the elongated adapter body;

wherein the elongated adapter body includes an arrow receiving cavity with an opening at the proximal end of the elongated adapter body, wherein the arrow receiving cavity is configured to receive a proximal end of an arrow; and wherein the opening of the arrow receiving cavity of the elongated adapter body forming the arrow receiving cavity, once assembled, has a width that is less than a width of the arrow receiving cavity at a point between the opening of the arrow receiving cavity and an end of the arrow receiving cavity positioned within the elongated adapter body, thereby preventing the elongated adapter body from being pulled off of the arrow.

14. The bowfishing nock adapter of claim 13, wherein the stop supporting element is configured to support a bowfishing line stop and is formed from at least one hole extending into the elongated adapter body.

15. The bowfishing nock adapter of claim 13, wherein the elongated adapter body being configured to support a nock at a distal end of the elongated adapter body comprises a nock receiving cavity having an opening at the distal end of the elongated adapter body and at least one slot positioned in a wall of the elongated adapter body.

16. A bowfishing nock adapter, comprising:

an elongated adapter body configured to be attached to a distal end of an arrow at a proximal end of the elongated adapter body;

wherein the elongated adapter body is configured to support a nock at a distal end of the elongated adapter body;

a stop supporting element configured to support a bowfishing line stop, wherein the stop supporting element is positioned between the proximal and distal ends of the elongated adapter body;

wherein the arrow receiving cavity includes an arrow retention system configured to enable the elongated adapter body to be securely attached to the arrow; and wherein the opening of the arrow receiving cavity of the elongated adapter body forming the arrow receiving cavity, once assembled, has a width that is less than a width of the arrow receiving cavity at a point between the opening of the arrow receiving cavity and an end of the arrow receiving cavity positioned within the elongated adapter body, thereby preventing the elongated adapter body from being pulled off of the arrow.

17. The bowfishing nock adapter of claim 16, wherein the elongated adapter body being configured to support a nock at a distal end of the elongated adapter body comprises a nock receiving cavity having an opening at the distal end of the elongated adapter body and at least one slot positioned in a wall of the elongated adapter body.

18. A bowfishing arrow, comprising:

an elongated shaft with a distal end and a proximal end;

wherein the proximal end of the elongated shaft includes a connection portion;

wherein a distal end of the connection portion has a width that is greater than a width at an intersection of the connection portion and a remainder of the elongated shaft, whereby an outer surface of the connection portion is nonparallel and nonorthogonal with a longitudinal axis of the elongated shaft; and a bowfishing nock adapter comprising an elongated adapter body configured to be attached to the connection portion of the bowfishing arrow at a proximal end of the elongated adapter body and wherein the elongated adapter body is configured to support a nock at a distal end of the elongated adapter body.

19. The bowfishing arrow of claim 18, wherein the elongated adapter body being configured to support a nock at a distal end of the elongated adapter body comprises a nock receiving cavity having an opening at the distal end of the elongated adapter body and at least one slot positioned in a wall of the elongated adapter body.

20. The bowfishing arrow of claim 18, further comprising a stop supporting element configured to support a bowfishing line stop, wherein the stop supporting element is positioned between the proximal and distal ends of the elongated adapter body.

* * * * *